US006109807A

United States Patent [19]

Joulia et al.

[11] Patent Number: 6,109,807

[45] Date of Patent: Aug. 29, 2000

[54] ROTATING COVER, AS USED FOR A LIPSTICK

[75] Inventors: Pierre Joulia, Saint Jorioz; Stéphane Demellier, Annecy, both of France

[73] Assignee: Conception Et Moulage Au Service de l'Industrie, Attignat, France

[21] Appl. No.: 08/921,680

[22] Filed: Sep. 2, 1997

[30] Foreign Application Priority Data

Sep. 3, 1996 [FR] France ..... 96 10939

[51] Int. Cl.[7] ..... B43K 21/08

[52] U.S. Cl. ..... 401/78; 401/87

[58] Field of Search ..... 401/78, 87, 49, 401/77, 75, 68

[56] References Cited

U.S. PATENT DOCUMENTS

| | | | |
|---|---|---|---|
| 2,222,415 | 11/1940 | Landwehr | 206/56 |
| 2,385,643 | 9/1945 | Place | 206/56 |
| 2,411,975 | 12/1946 | Nelson | 401/87 X |
| 2,504,490 | 4/1950 | Broder | 206/56 |
| 4,560,297 | 12/1985 | Leem | 401/76 X |
| 5,234,275 | 8/1993 | Gueret | 401/78 |

FOREIGN PATENT DOCUMENTS

| | | | |
|---|---|---|---|
| 243328 | 10/1987 | European Pat. Off. | 401/78 |
| 393377 | 10/1990 | European Pat. Off. . | |
| 620127 | 10/1994 | European Pat. Off. . | |
| 2620602 | 3/1989 | France | 401/78 |
| 468035 | 6/1937 | United Kingdom . | |
| 863995 | 3/1961 | United Kingdom | 401/87 |

*Primary Examiner*—David J. Walczak

*Attorney, Agent, or Firm*—Fay, Sharpe, Fagan, Minnich & McKee, LLP

[57] ABSTRACT

Lipstick refills in a plurality of colors are packaged in a cylindrical body (3), which is clear plastic along its upper half. The body defines one or more helical grooves (7) in a lower half which receive tips (6*a*, 6*b*) of a sliding unit (4) in which a stick of lipstick is received. A pointed hollow element (12) covers the stick of lipstick during transportation and sale, but is removed for use. The sliding unit defines one or more longitudinal grooves (5*a*, 5*b*) which slidingly receive longitudinally extending ribs (2*a*, 2*b*) of a base (1) when detents (8*a*) of the base snap into annular groove (9) of the body. As the body and base are rotated relative to each other, the interaction of the longitudinal ribs (2*a*, 2*b*) and the longitudinal groove (5*a*, 5*b*) cause the sliding unit to rotate relative to the body and follow along the spiral grooves extending and retracting the stick of lipstick.

13 Claims, 6 Drawing Sheets

FIG. 3
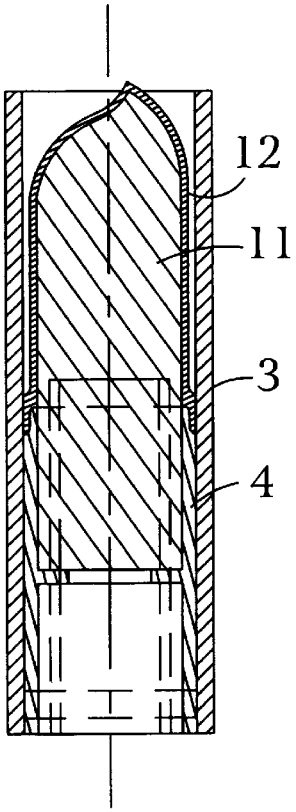
FIG. 4
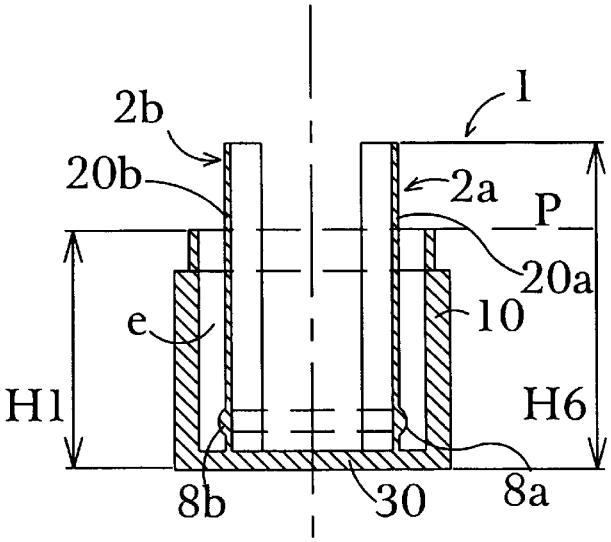
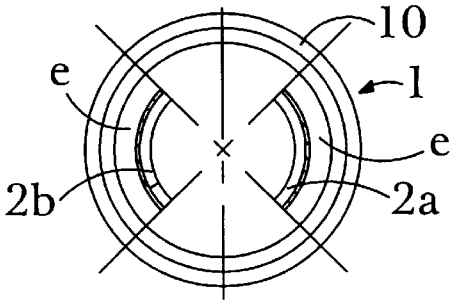
FIG. 5

FIG. 6
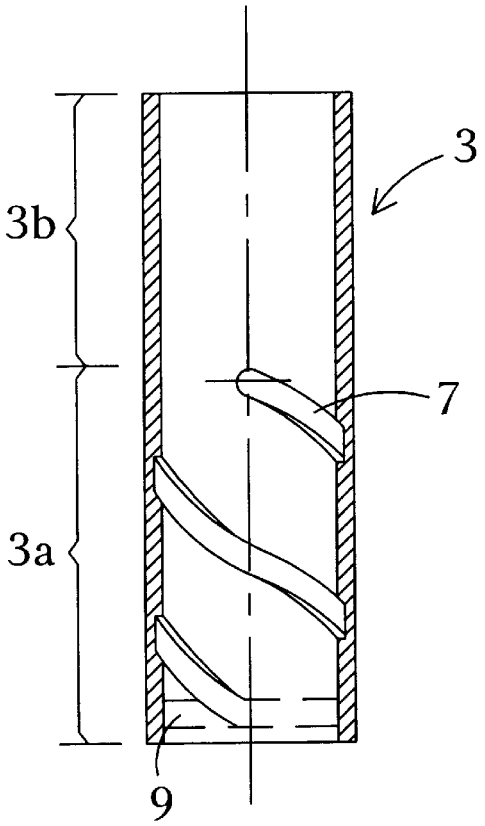
FIG. 7
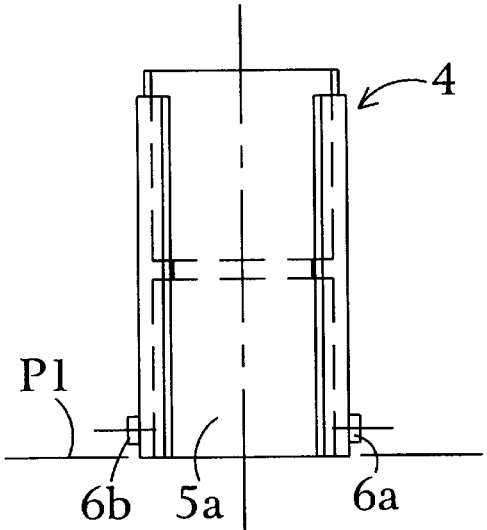
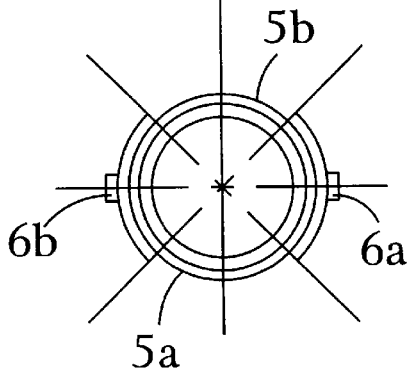
FIG. 8

1
11
3

1
3
4
11
1
11

3
4
11

3
4

3
4
4
3

3

ROTATING COVER, AS USED FOR A LIPSTICK

BACKGROUND OF THE INVENTION

The present invention concerns a rotating cover as used for a tube of lipstick. More specifically, it concerns an improvement.

Lipstick covers are already known, comprising a turning mechanism permitting extraction or retraction of the lipstick from/into a protective cover. This mechanism generally comprises:

an exterior circular cylindrical body, a sliding unit supporting the lipstick, mounted axially movable in the body and the base, its mobility being controlled by a rotational movement of the base relative to the body of the casing, a base, rotating relative to the body, capable in case of the bottom casings, of rising in the interior of the body up to its top, like a sheath, or likewise equipped in its interior circumference with guidance spirals for the sliding unit.

In regard to the known casings, the height of the base which is located below the guidance zone of the sliding unit and its travel, further increases the height of the casing, which increases the height of the base. In addition, the height of the base must at least be equal to the travel of the sliding unit. As a result, the height of the base has a penalizing effect upon the visible height of the body insofar as total standard casing height is concerned. It is thus clear that the traditional casings present drawbacks which limit the utilization of their design.

It is the object of the present invention to propose a new rotating casing mechanism, which is economical to produce and economical with respect to investment in equipment, and which holds great possibilities in terms of estheticism and ergonomics, while combining all the other functions such as simplified packaging by casting the paste material behind the sliding unit and also casing design suitable for economical refills. In addition, construction according to the invention allows that a very short rotating casing is obtained for a given length of lipstick.

SUMMARY OF THE INVENTION

Thus, according to the invention, the rotating casing, such as a tube of lipstick, comprises a base, a body and a sliding unit destined to receive the lipstick, characterized in that it comprises means of blocking rotation of the sliding unit relative to the body and guidance means for displacement of said sliding unit relative to the base.

According to additional characteristics, the means for blocking of rotation and the guidance means are constituted by at least one rib, which is integral with the base, constituting, furthermore, a guidance projection, destined to cooperate with at least one indentation realized in the wall of the sliding unit.

According to another characteristic, the body is blocked in longitudinal translation according to the general axis, thanks to at least one external projection arranged at the lower portion of the rib destined to cooperate with a circular groove realized at the lower portion of the body.

Furthermore, the bottom portion of the body comprises at least one spiral groove in which at least one tip is engaged, jutting out relative to the peripheral wall of the sliding unit, and in order to let the top portion of the body pass the base, is smooth and without groove.

According to another additional characteristic, the two guidance tips are arranged at the lower portion of the sliding unit as close as possible to the extreme lower plane, whereas the ribs originate at the lower portion of the body.

In a preferred specific embodiment, the base is constituted by an external peripheral wall and by a bottom from which project two ribs, constituted by two portions of the cylindrical wall, diametrically opposed, the portions of the wall being cylindrical and arranged at the interior of the base in order to leave between them and the external peripheral wall of the body a space destined to receive the body, whereas said body is free in rotation in the space relative to the base in order to be blocked in longitudinal translation thanks to two external projections arranged at the lower portion of ribs destined to cooperate with a circular groove realized at the lower portion of the body.

It should be noted that the body and the sliding unit form a sub-assembly, which can be detached from the base in order to form an interchangeable refill, while said sub-assembly constituted by the body and the sliding unit can receive a protective rib and/or is suitable for serving as a mold for casting the lipstick paste material.

According to a variation, tightness with respect to water, air and solvents is assured in the bottom portion by the cooperation of the surfaces of the base or rather the surfaces of the body of the base, while in the top portion same is assured by the cooperation of the surfaces of a central cylindrical projection of the cover with a peripheral internal rim of the body.

Other characteristics and advantages of the invention are apparent from the description given below based on the attached drawings, which are given by way of example only and not limited thereto.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIGS. 1 and 2 are a view of longitudinal sections of the case without the protective cover, FIG. 1 being a view of the case in position of a retracted lipstick tube, namely in the protected position, whereas FIG. 2 is a view in the extracted position of utilization, namely the position of application.

FIG. 3 is a view in longitudinal section of a refill of the casing.

FIG. 4 is a view in longitudinal section of the base.

FIG. 5 is a bird's eye view of the base.

FIG. 6 is a view in longitudinal section of the body.

FIG. 7 is an exterior lateral view of the sliding unit.

FIG. 8 is a view from above of the sliding unit.

DETAILED DESCRIPTION OF THE PREFERRED EMBODIMENTS

Figure 1:
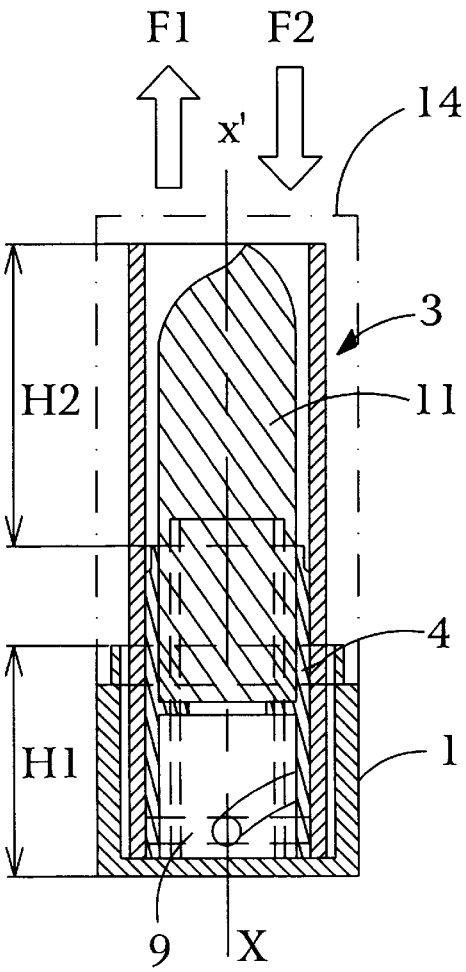

The mechanism shown in FIGS. 1 and 8 basically comprises a base (1), a body (3) and a sliding unit (4). The base (1) is constituted by an external peripheral wall (10) and a bottom (30) from which bottom jut out, in upward direction, two ribs (2*a*, 2*b*) constituted by two diametrically opposed cylindrical wall portions (20*a*, 20*b*). The wall portions (20*a*, 20*b*) being circularly cylindrical along and around the axis (XX') and arranged on the inside of the base in order to leave between them and the external peripheral wall (10) of the body a circularly cylindrical space "e" destined to receive the body (3). It should be noted that said body (3) is free to rotate in space "e" relative to the base (1).

Furthermore, the body (3) is blocked in longitudinal translation, thanks to two external projections (8*a*, 8*b*) arranged at the lower portion of the ribs (2*a*, 2*b*) which cooperate with a circular groove (9) defined in the lower portion of the body (3). Needless to say, one may also provide only one projection.

It should be noted that the sliding unit (4) is mobile in vertical displacement, but blocked from rotating relative to the base by cooperation of the two ribs (2*a*, 2*b*) with the two corresponding indentations (5*a*, 5*b*) defined on the sliding unit (4).

Figure 2:
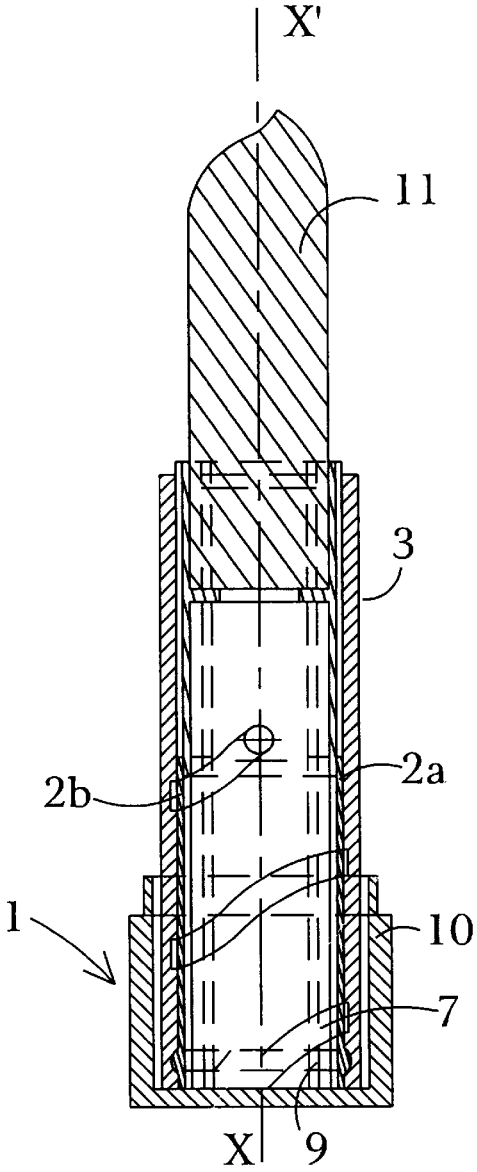

The longitudinal displacement of the sliding unit (4) supporting the lipstick shaft (11) that is to say the displacement from the protected position (FIG. 1) toward the application position (FIG. 2) and vice versa takes place by rotation of the base (1) relative to the body (3) thanks to the cooperation of the two tips (6*a*, 6*b*) arranged on the external surface of the sliding unit (4) with two corresponding spiral grooves (7) realized in the wall of the body (3).

In order to obtain a casing of the shortest possible length, the two guidance tips (6*a*, 6*b*) are arranged at the lower portion of the sliding unit (4) as close as possible to the lower extremity plane (P), whereas the spiral grooves (7) have their origin in the lower portion of the body (3).

According to one characteristic, the spiral grooves (7) are arranged in the lower bottom portion (3*a*) of the body (3), concealed by height (H1) of base (1), thus permitting, when the body (3) is of transparent material, to obtain an upper cylindrical surface (3*b*) totally smooth, letting appear, under optimum optical conditions, the color of the product or of the lipstick (11).

It should, in addition, be noted that the mechanism is furthermore characterized in that the visible height (H1) of the base (1) can vary from minimum to maximum, while observing a standard height (H2) for the product (11) which is to be exposed on extension.

In addition, the frictional turning resistance of the slip coupling is determined by the force exercised by the projection or projections (8*a*, 8*b*) of the ribs (2*a*, 2*b*) cooperating by deflection with the interior groove (9).

One will note, according to another characteristic, that the body (3) and the sliding unit (4) form a sub-assembly, capable of detachment from the base (1) by a pulling force exerted according to F1 along axis (x) and capable of being assembled by pressure according to F2, in base (1), with the body (3) and the sliding unit (4) with its lipstick (11) forming a sub-assembly which can be separated from the base (1) and thus constituting an interchangeable refill as illustrated in FIG. 3; the separation takes place by pulling toward to top until release of projections (8*a*, 8*b*) from the interior groove (9). Furthermore, this assembly forming a sub-assembly can receive a hollow pointed housing (12) destined to serve as mold for the casting of the lipstick paste, the sliding unit (4) and the hollow pointed housing (12), packed with the lipstick paste (11) form a simplified refill for the lipstick cover. Moreover, the hollow pointed housing (12) can also serve as mould for the casting of the lipstick paste (11).

Of course, the mechanism can accept a protective cover (14) as represented by fine lines in FIG. 1, which is going to position itself on the base (1) and around the body (3) in order to completely close the tube, specifically the tube of lipstick.

Figure 9:
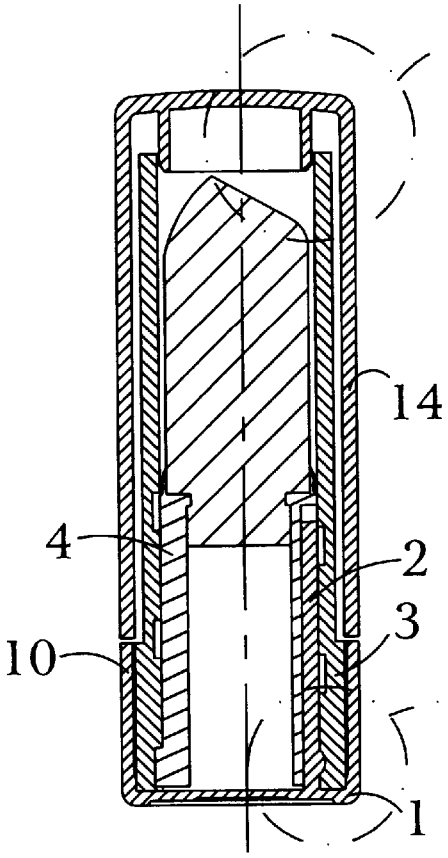
FIG. 9 shows details of the tightness of the cover, with FIGS. 9*a* and 9*b* representing enlarged scale views.
Figure 9A:
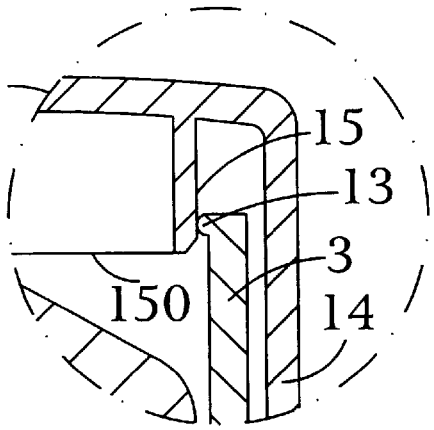
Figure 9B:
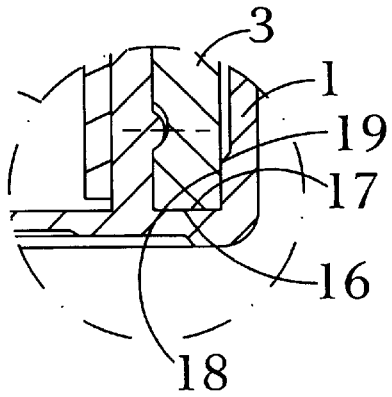

FIGS. 9, 9*a*, 9*b* indicate in longitudinal section the details relative to tightness between the cover (14) and the body (3) as well as between the base (1) and the body (3).

When the mechanism is closed by the cover (14), tightness with respect to water, air and solvents is assured in the top portion by cooperation of the surfaces (15) of a central cylindrical projection (150) of the cover (14) and a peripheral internal rim (13) of the body (3). In its bottom portion, tightness is assured by cooperation between the surfaces (18) of the body (3, 19) of the base (1) or the surfaces (17) of the body (3, 16) of the base (1). These two possibilities can be combined.

Figure 10:
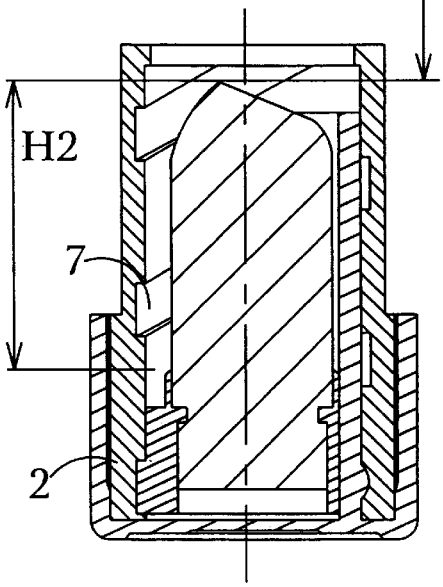
FIGS. 10 and 11 representing a variation of the embodiment according to views similar to FIGS. 1 and 2, however in longitudinal section, at right angle.
Figure 11:
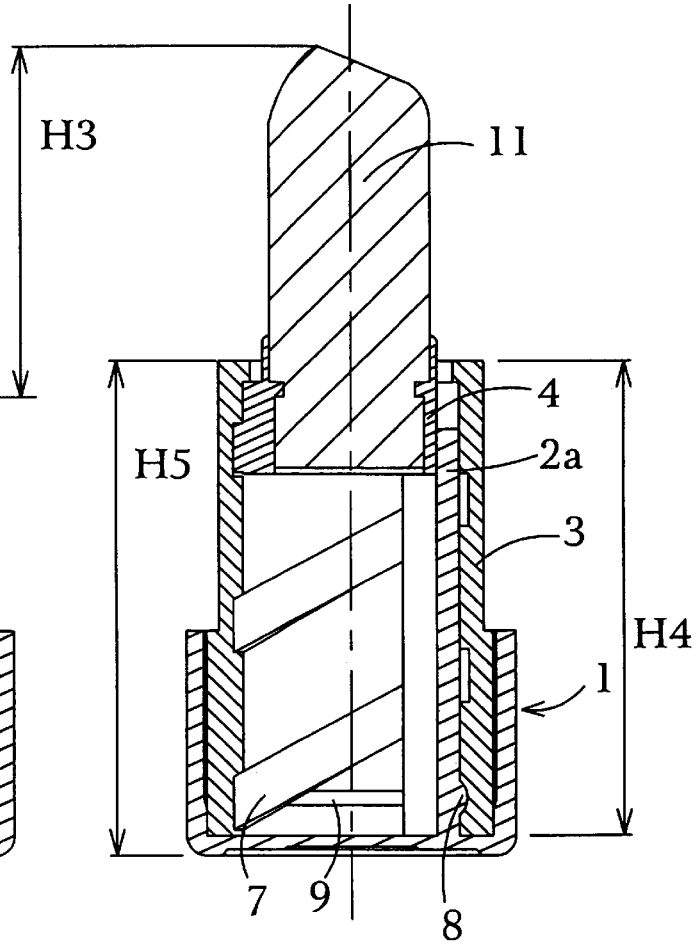

FIGS. 10 and 11 illustrate a variation in embodiment according to which the height (H4) of the body (3) is dimensioned as small as possible for the length (H3) of the distribution course and for a given height (H2) of the lipstick, with the height (H5) of the casing then being very small.

Figures 12A, 12B, 12C, 12D, 12E, 12F:
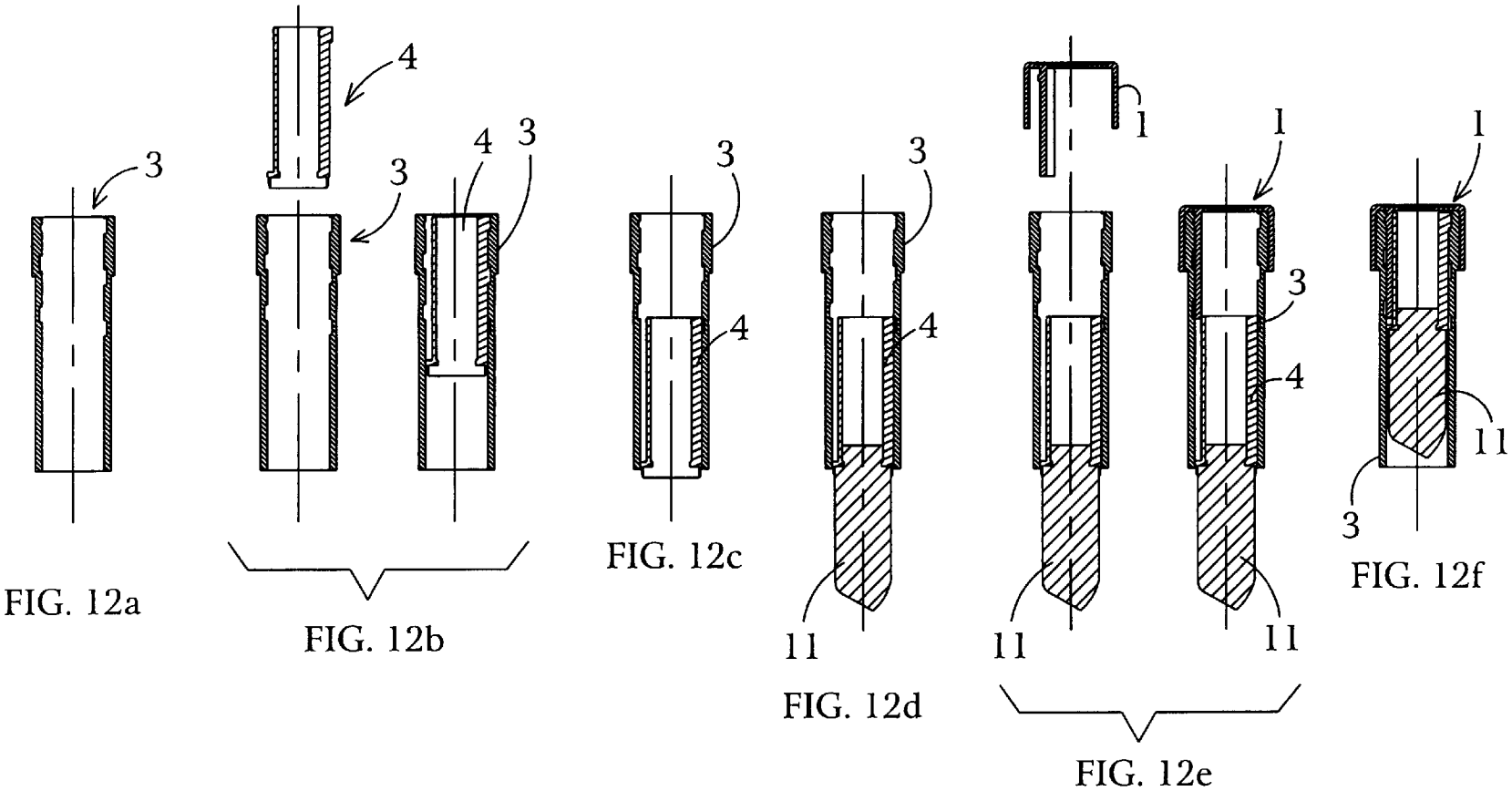
FIGS. 12*a*–12*f* illustrates the different mounting and packaging stages of the mechanism.

FIG. 12 illustrates different assembly and packaging stages of the mechanism. Thus, after having realized the body (3) and the sliding unit (4), the latter is introduced into said body (3), FIG. 12*b*, until the two tips (6*a*, 6*b*) have become engaged in the spiral grooves. The sliding unit (4) is then displaced to distribution position (FIG. 12*c*) in order to receive the lipstick (11) FIG. 12*d*. The base (1) is then put into place on the body/sliding unit assembly (3, 4) FIG. 12*e*. The sliding unit (4) is then retracted into the position of protection.

One will understand the simplicity of the rotating cover which comprises a body (1) of short height and according to which the rotational blocking of the sliding unit (4) and its guidance during vertical displacement are realized by means of cooperation between the body and the sliding unit (4). Thus, the rotating cover comprises rotational blocking means of the sliding unit (4) relative to the body (1) and guidance means of said sliding unit (4) during displacement relative to the body.

The blocking and guidance means being constituted by cooperation of the two ribs (2*a*, 2*b*), extending toward the top and the corresponding indentations (5*a*, 5*b*) in which they are engaged. According to the illustrated embodiments one notes that the ribs (2*a*, 2*b*) extend in upward direction to a height (H6) greater than the height (H1), that is to say beyond plane P (FIG. 4), but one may also provide ribs (2*a*, 2*b*) which do not extend beyond the height (H1) of the body, in order to be totally concealed by the wall (10) of the base (1).

Furthermore, one will note that the spiral grooves (7) do not extend over the entire height of the body but only over the lower portion (3*a*) which is concealed by the base, in a manner so as to leave the top portion (3*b*) totally smooth, without groove.

We are adding that the body (3) is beneficially realized in transparent material in order to allow the lipstick to be visible through the transparent material.

It goes without saying that one can have a base (1) without having an external peripheral wall (10) without going outside the scope of the invention. In that case, the protective cover (14) would go down to the level of the bottom wall (30) of the base. It is self-understood as well, that one may provide only one single guidance rib (2).

Of course, the invention is not limited to the embodiments described and represented by way of examples, but includes also all technical equivalents as well as their combinations.

Having thus described the preferred embodiments, the invention is now claimed to be:

1. A rotating casing for a stick of lipstick, the casing comprising:

a base;

a body;

a sliding unit for receiving lipstick comprising a wall having an indentation defined therein;

a rotation blocking means for blocking rotation of a sliding unit relative to the body comprising at least one rib integral with the base; and a guidance means for guiding displacement of said sliding unit relative to the base comprising a guidance projection for cooperating with at least one indentation defined in the wall of the sliding unit;

wherein the body is blocked from the longitudinal translation by at least one external projection arranged at the lower portion of each rib for cooperating with a circular groove defined at the lower portion of the body.

2. The rotating casing according to claim 1, wherein a bottom portion of the body includes at least one spiral groove in which at least one tip is jutting out relative to the peripheral wall of the sliding unit is engaged leaving a top portion of the body extending beyond the base smooth and without grooves.

3. The rotating casing according to claim 2, wherein two guidance tips are arranged at a lower portion of the sliding unit, as close as possible to a lowermost edge of the sliding unit and the groove originates in the bottom portion of the body.

4. The rotating casing according to claim 1, wherein the body and the sliding unit form a sub-assembly which is detachable from the base in order to form an interchangeable refill.

5. The rotating casing according to claim 4, wherein the sub-assembly constituted by the body and the sliding unit has a cover for engaging the lipstick tube.

6. The rotating casing according to claim 1, wherein cooperation of surfaces of the body and the base engage with sufficient tightness to block penetration by water, air, and solvents.

7. A lipstick case comprising:

a replaceable cartridge including:

a cylindrical body which defines a spiral groove on a lower, interior surface thereof, a cylindrical sliding unit having a detent which engages the spiral groove in the body and defining at least one indentation, a stick of lipstick carried by the sliding unit;

a base which receives a lower end of the body therein, the base defining at least one rib which is received in the longitudinal groove in the sliding unit when the body is received in the base;

an annular groove and projection coupling which releasably interconnects the body and the base such that the body is free to rotate relative to the base, longitudinally sliding interaction between the rib on the base and the indentation on the sliding unit constraining the sliding unit to remain in a controlled rotational orientation relative to the base such that as the base and body are rotated relative to each other at the annular groove and projection coupling, the body rotates relative to the sliding unit and sliding interaction between the sliding unit and the spiral groove causing the sliding unit and the stick of lipstick to extend and retract.

8. The lipstick case as set forth in claim 7 wherein the body is at least partially transparent on an upper portion thereof such that a color of the stick of lipstick is determinable through the transparent body portion.

9. The lipstick case as set forth in claim 7 further including a cylindrical cover which extends over the cylindrical body when the sliding unit is retracted and frictionally engages the base.

10. The lipstick case as set forth in claim 7 further including a pointed hollow element in which the stick of lipstick is molded, the pointed hollow element being removably interconnected with the sliding unit, the pointed hollow element covering and protecting the stick of lipstick, but being removable to allow the stick of lipstick to be utilized.

11. A lipstick case comprising:

a replaceable lipstick cartridge including:

a cylindrical body which defines a spiral groove on a lower interior surface thereof, wherein the spiral groove is defined only on a lower half of the body, a cylindrical sliding unit having a tip which engages the spiral groove in the body and defining at least one indentation, a stick of lipstick carried by the cylindrical sliding unit;

a base which receives a lower end of the body therein, the base defining at least one rib which is received in the indentation in the cylindrical sliding unit when the body is received in the base, and the rib is defined adjacent a lower-most end of the cylindrical sliding unit;

an annular groove and projection coupling which releasably interconnects the body and the base such that the body is free to rotate relative to the base, longitudinally sliding interaction between the rib on the base and the indentation on the cylindrical sliding unit constraining the cylindrical sliding unit to remain in a controlled rotational orientation relative to the base such that as the base and body are rotated relative to each other at the annular groove and projection coupling, the body rotates relative to the cylindrical sliding unit and sliding interaction between the cylindrical sliding unit and the body spiral groove causing the cylindrical sliding unit and the stick of the lipstick to extend and retract.

12. A rotating case for a stick of lipstick, the case comprising:

a base;

a body;

a sliding unit for receiving lipstick comprising a wall having an indentation defined therein and a rotation blocking means for blocking rotation of the sliding unit relative to the body and, a guidance means for guiding displacement of said sliding unit relative to the base comprising a rib for cooperating with at least one indentation defined the wall of the sliding unit, further wherein;

the base has an external peripheral wall and a bottom from which bottom, two diametrically opposed cylindrical wall portions jut out in an upward direction from the bottom, the wall portions being symmetrical about an axis and arranged on the inside of the base to define a space for receiving a peripheral wall of the body, said body being free to rotate in the space relative to the base and being blocked against longitudinal translation by two external projections arranged at the lower of the two diametrically opposed cylindrical wall portions which external projections cooperate with a circular groove defined in the lower portion of the body;

the body includes at least one spiral groove jutting out relative to a peripheral wall of the sliding unit and a tip for engaging each spiral groove wherein upon tip engagement with said spiral grooves a top portion of the body extends beyond the base and is smooth and without grooves.

13. A rotating case for a stick of lipstick, the case comprising:

a base;

a body;

a sliding unit for receiving lipstick comprising a wall having an indentation defined therein;

a rotation blocking means for blocking rotation of the sliding unit relative to the body comprising at least one rib integral with the base;

a guidance means for guiding displacement of said sliding unit relative to the base comprising a guidance projection for cooperating with at least one indentation defined in the wall of the sliding unit; and, wherein the body is blocked from longitudinal translation by at least one external projection arranged at the lower portion of each rib for cooperating with a circular groove defined at the lower portion of the body;

and, wherein cooperation of surfaces of the body and the base engage with sufficient tightness to block penetration by water, air, and solvents, further wherein the tightness with respect to water, air, and solvents is assured by cooperation of surfaces of a central cylindrical projection of a cover with an internal peripheral rim of the body.

* * * * *